US006659494B1

(12) United States Patent
Martin

(10) Patent No.: US 6,659,494 B1
(45) Date of Patent: Dec. 9, 2003

(54) BACKWARDS RELEASE SKI BINDING ON A PIVOT PLATE MOUNT

(76) Inventor: Ralph M. Martin, 340 Cottonwood Ct., Longmont, CO (US) 80501

( * ) Notice: Subject to any disclaimer, the term of this patent is extended or adjusted under 35 U.S.C. 154(b) by 67 days.

(21) Appl. No.: 09/774,231

(22) Filed: Jan. 30, 2001

Related U.S. Application Data

(63) Continuation-in-part of application No. 09/748,970, filed on Dec. 27, 2000.

(60) Provisional application No. 60/224,312, filed on Aug. 10, 2000.

(51) Int. Cl.[7] ..... A63C 9/088

(52) U.S. Cl. ..... 280/612

(58) Field of Search ..... 280/612, 613, 280/617, 618, 625, 634, 637, 631, 809, 819

(56) References Cited

U.S. PATENT DOCUMENTS

| | | | | | |
|---|---|---|---|---|---|
| 2,616,714 | A | | 11/1952 | Cubberley | |
| 3,528,672 | A | * | 9/1970 | Wunder | 280/612 |
| 3,612,559 | A | | 10/1971 | Petersen et al. | |
| 3,794,339 | A | * | 2/1974 | Smolka | 280/612 |
| 3,820,803 | A | * | 6/1974 | Frisch et al. | 280/612 |
| 3,866,929 | A | | 2/1975 | Lacroix | |
| 3,870,326 | A | | 3/1975 | Cubberley | |
| 3,888,498 | A | * | 6/1975 | Gertsch et al. | 280/634 |
| 3,961,802 | A | | 6/1976 | Vannatter | |
| 3,976,308 | A | | 8/1976 | Napflin | |
| 4,003,587 | A | | 1/1977 | Salomon | |
| 4,121,854 | A | * | 10/1978 | Cornu | 280/612 |
| 4,129,245 | A | | 12/1978 | Bonvallet | |
| 4,135,735 | A | | 1/1979 | Beyl | |
| 4,324,409 | A | | 4/1982 | Larsen et al. | |
| 4,415,176 | A | | 11/1983 | Hull | |
| 4,418,937 | A | | 12/1983 | Salomon | |
| 4,512,594 | A | | 4/1985 | Eyre | |
| 4,545,598 | A | * | 10/1985 | Spitaler et al. | 280/612 |
| 4,572,541 | A | | 2/1986 | Bernard et al. | |
| 4,835,523 | A | | 5/1989 | Pruett | |
| 5,150,913 | A | | 9/1992 | Hoelzl | |
| 5,188,387 | A | | 2/1993 | Ruffinengo | |
| 5,308,102 | A | | 5/1994 | Bildner | |
| 5,328,201 | A | | 7/1994 | Wladar | |
| 5,362,087 | A | | 11/1994 | Agid | |
| 5,411,283 | A | * | 5/1995 | Nowak et al. | 280/618 |
| 5,498,017 | A | * | 3/1996 | Rohrmoser | 280/617 |
| 5,501,483 | A | | 3/1996 | Stepanek et al. | |
| 5,513,872 | A | * | 5/1996 | Arduin et al. | 280/618 |
| 5,556,122 | A | * | 9/1996 | Arduin et al. | 280/618 |
| 5,743,550 | A | | 4/1998 | Frohwein | |
| 5,813,690 | A | * | 9/1998 | Dogat | 280/634 |
| 6,007,086 | A | * | 12/1999 | Hopkins | 280/612 |
| 6,196,570 | B1 | | 3/2001 | Klubitschko | |
| 6,206,404 | B1 | | 3/2001 | Buquet et al. | |

FOREIGN PATENT DOCUMENTS

| | | | | |
|---|---|---|---|---|
| CH | 467 081 | | 1/1969 | A63C/9/00 |
| DE | 304 329 | | 12/1972 | A63C/9/08 |
| DE | 2402684 | * | 7/1975 | 280/612 |
| DE | 2406015 | * | 8/1975 | 280/612 |
| DE | 2408965 | * | 9/1975 | 280/612 |
| DE | 2721691 | * | 12/1977 | 280/612 |
| EP | 0336782 | * | 10/1989 | 280/612 |

OTHER PUBLICATIONS web site: www.aspenhistory.com/tipchp3.html; date : Jan. 20, 2003; title: Tip to Tale—Bindings; author: unknown (paper copy provided in file).

PCT Search Report—Date of Mailing Nov. 21, 2001.

* cited by examiner

*Primary Examiner*—Frank Vanaman

(74) *Attorney, Agent, or Firm*—Rick Martin; Patent Law Offices of Rick Martin, P.C.

(57) ABSTRACT

Downhill ski bindings are mounted with the toe and/or heel piece mounted to a moveable track. For a quick release even backward, a ski pole handle button is depressed. A signal reaches a receiver on the ski. The receiver activates an actuator which pulls the track, thereby enlarging a mounting distance for the boot. The boot is released since the binding system is instantly sized too big for the boot. Gas and spring release mechanisms are disclosed. Sound making subsystems are disclosed. Pivoting heel mounting plates are disclosed.

6 Claims, 17 Drawing Sheets

BACKWARDS RELEASE SKI BINDING ON A PIVOT PLATE MOUNT

CROSS-REFERENCE TO RELATED APPLICATION

The present application is a continuation in part claiming priority to provisional U.S. application No. 60/224,312 filed Aug. 10, 2000 and parent U.S. application Ser. No. 09/748,970 filed Dec. 27, 2000.

FIELD OF THE INVENTION

The present invention relates to automatically via a ski pole transmitter releasing ski bindings by pushing a button on the ski pole bindings or another transmitter button remote from the ski bindings and optionally activating a sound module on the ski.

BACKGROUND OF THE INVENTION

It is estimated that over 10,000 crippling knee injuries occur each ski season in Colorado, U.S.A., alone. Extrapolating worldwide there might be over 50,000 knee injuries each ski season worldwide. Great advances have been made in downhill ski bindings to automatically release during violent forward falls. Several problems exist with the best downhill ski bindings.

The most serious problem is the slow, twisting backward fall. Most anterior cruciate ligament (ACL) injuries occur with this type of fall. Expert skiers teaching children fall during a lesson and tear their ACL. A damaged ACL can be treated with a modern, complex, and expensive surgery called a patella tendon graft replacement for the ACL. Other body parts such as the hamstring tendon can also be used to replace the damaged ACL.

Thus, two surgeries are required. First a body part such as the patella tendon is harvested. Second the damaged ACL is removed and replaced with the harvested body part.

A good result requires six months of the replacement ACL to gain strength and function like the original ACL. About a year's physical therapy is required to regain maximum use of the leg. Two wounds must heel, without infection. Stiffness in the knee joint sometimes leads to loss of full range of motion. Atrophy of the leg muscles from the down time of surgery adds stress to the already weakened knee. Additional ACL and related injuries do occur. An average cost of one procedure with therapy is about $15,000.00.

All this misery can stem from one careless fall backwards while standing in the ski line. Following your child at 3 mph can lead to a slow backwards fall and a crippling ACL injury. Nobody has invented a working solution to this one worst injury so frequently caused by a careless moment on downhill skis.

A large portion (perhaps half) of all ACL injuries occur at slow speeds falling backwards. Therefore, a couple of seconds of reaction time exists for a trained skier (either novice or expert) to push an emergency release button on his ski pole handle and totally eject from his skis. With the present invention by the time the skier hits the ground, he's out of his skis without exerting any rotational torque to his knees. Properly trained skiers using the present invention can reduce the risk of ACL injury by a large percent, perhaps even half. This could mean 25,000 fewer worldwide ACL injuries a year and a much safer sport overall.

Other uses for this emergency release system (also called a bail out™ system) include easy release for beginners so they can spend less time learning to stand up, and more time skiing. Upside down skiers in a tree hole can quickly release and quickly get out of a dangerous situation. A lost ski can be found in powder by activating a sound module powered by the same battery as is the binding release mechanism.

The basic principle of the present invention is to mount the heel and/or toe release segment of a ski binding on a short track. Pushing the release button energizes a stored force on the ski to move the heel and/or toe binding along the track to a position larger than the ski boot. The result is a size 10 boot in a size 12 binding. The skier is instantly free of his skis.

To remount the skier resets his binding to the loaded and properly sized position, steps in, and skis as usual.

PRIOR ART NOWAK (U.S. Pat. No. 5,411,283)/ ARDUIN (U.S. Pat. Nos. 5,513,872 AND 5,556,122) DISCUSSION

Nowak describes a heel binding member which is mounted on a plate. The plate 1 has a forward axle 41 which allows the heel binding member to pivot up a small distance, thereby activating a force receiver which releases a releasable heel jaw 17' at a preset upward force. The plate 1 also has a centrally located pin and socket joint to allow the plate 1 to slide left and right a small distance, thereby activating the force receiver which releases the releasable heel jaw 17' at a preset side to side force. The rear of the plate also has a ski fixed abutment 2 which houses the force receiver. Thus, the plate 1 requires three anchor points as taught by Nowak. Nowak does not teach nor support a pivotable heel plate which has only a single axle attachment to the ski, wherein the pivotable heel plate supports a prior art spring action step in heel binding member.

The Arduin references are assigned to Salomon®, which company also makes the new Pilot® system noted in Applicant's specification. Arduin '122 at col. 3, line 61, states that the toe and heel elements are affixed to the stiffening blade 5 which is affixed to the ski 4 (see FIG. 4). One embodiment shows stiffening blade 5 as a single piece, and one shows it to be two portions (col. 6, line 43). In either case the stiffening blade 5 supports the heel binding member along a plurality of contact points with the base of the ski. The Pilot® system only has a single pivot support structure for attachment of the pivotable heel plate to the base of the ski.

SUMMARY OF THE INVENTION

The main aspect of the present invention is to provide a track on a ski binding element, wherein a remote release button powers the ski binding element to move on the track to a position larger than the skier's proper boot and binding locked position.

Another aspect of the present invention is to provide a transmitter button on a ski pole to activate the movement of the ski binding on the track.

Another aspect of the present invention is to provide a spring having an electronically activated release mechanism on the ski to move the binding element on the track.

Another aspect of the present invention is to provide a compressed gas canister on the ski to move the ski binding element on the track.

Another aspect of the present invention is to provide a mounting plate with a track to house a toe and heel element of a ski binding.

Another aspect of the present invention is to provide a loud "bang" noise by remote control in order to locate a ski lost in powder.

Another aspect of the present invention is to use colored gas to more easily locate a lost ski in powder by remote control.

Another aspect of the present invention is to provide a sound module such as a chirper chip on the ski binding to remotely sound off the sound module to help locate a lost ski.

Another aspect of the present invention is to mount the release mechanism on a pivoting mounting plate on either the toe or heel binding segment (or both), wherein the pivoting mounting plate is designed to create a "no flat spot" curved edge in a carved turn.

Other aspects of this invention will appear from the following description and appended claims, reference being made to the accompanying drawings forming a part of this specification wherein like reference characters designate corresponding parts in the several views.

The preferred embodiment uses the stored energy of a spring in a housing mounted to the rear of a ski binding heel element. A radio signal activated mechanism releases the spring which moves the ski binding heel element back along a track to very rapidly release a skier from his binding.

To reload the spring a ratchet and handle may be used to load the spring and move the ski binding heel element forward to the skiing position.

All normal functions of a modern, forward release ski binding remain intact.

The preferred embodiment of the track style release binding is factory built with the initial ski binding integrated into the ski via a pivoting mounting plate.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

BRIEF DESCRIPTION OF THE INVENTION

Figure 1:
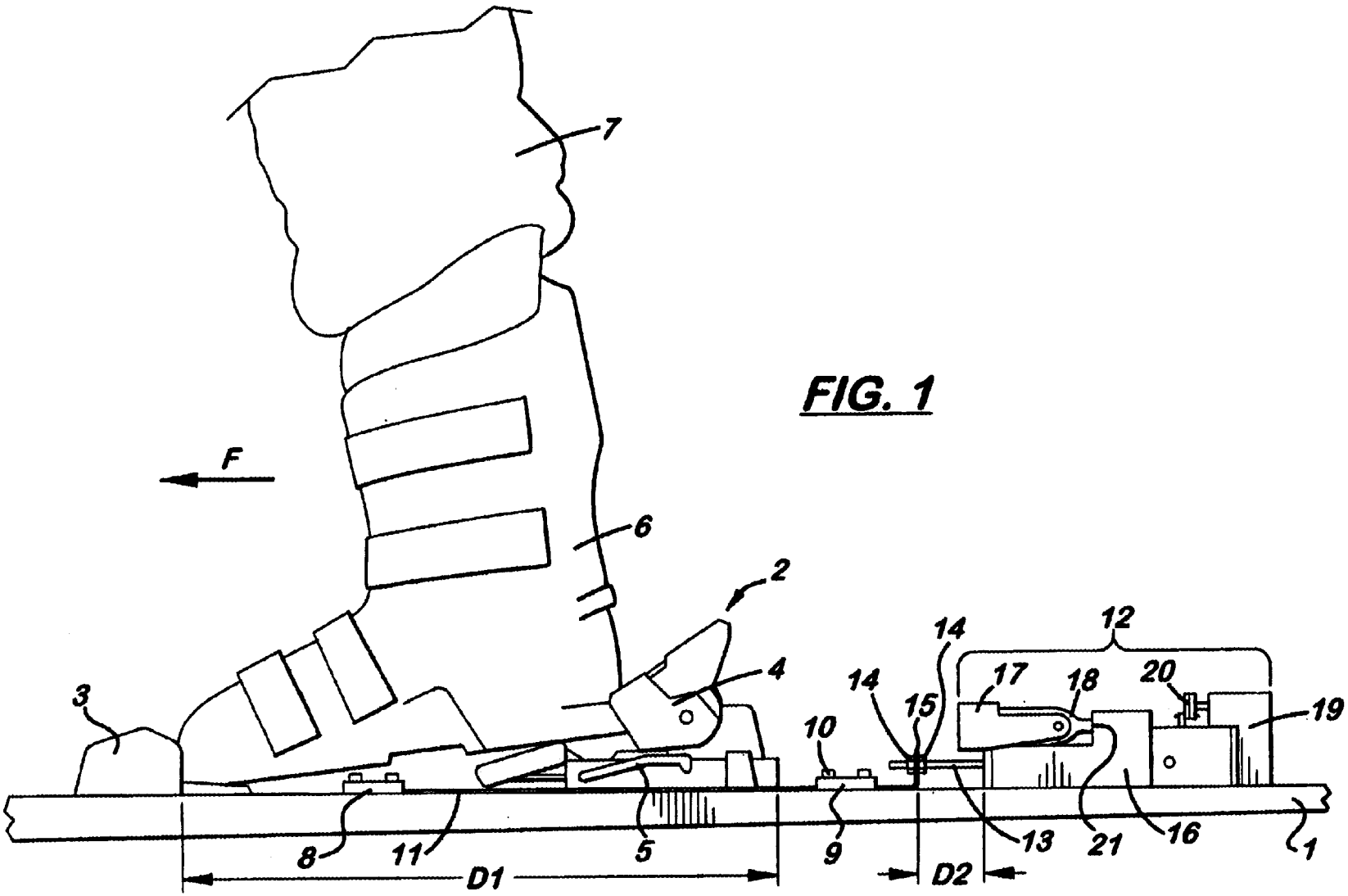
FIG. 1 is a right side plan view of a gas operated release embodiment.

Referring first to FIG. 1 a downhill ski 1 has a traditional forward release binding system 2 comprising a toe release mechanism 3, a heel release mechanism 4 and a snow brake 5. When the skier 7 falls forward his boot 6 moves forward in direction F thereby releasing the binding system 2 in a known manner. Upon release the snow brake 5 is thrust downward.

The heel release systems (both gas and spring) mount the heel release system 4 on a track 11. Anchors 8,9 hold the track 11 on the ski 1 and enable the track 11 to move forward and backward. Fasteners 10 hold the anchors 8,9 to the ski 1.

The heel release mechanism 12 has a piston arm 13 that is shown holding the heel release system 4 in the forward skiing position. The binding system 2 functions as a standard ski release system. The piston arm 13 connects to a flange 15 at the rear of the track 11. A hole (not shown) in the flange accepts the piston arm 13. Adjustment nuts 14 clamp the piston arm 13 to the flange 15.

The body 16 of the release mechanism 12 has a gas cylinder chamber filled with compressed (preferably) $CO_2$ gas which forces a piston forward as shown.

The principle of the release systems of the present embodiment use the concept that moving the heel release mechanism 4 a distance D2 (or a portion thereof) opens the binding system 2 to a size too big to hold the boot 6. The boot 6 will release in every direction especially backward when the binding system 2 is opened via the track 11. The distance D1 is the proper distance between the toe and heel release members to fit the boot 6. In prototype mode the distance D2 is about a half-inch.

The release mechanism 12 shown is a $CO_2$ gas cartridge activated device. The skiing position shown has a gas cylinder cartridge 18 in the housing 16, wherein the lever arm 17 has pushed the head of the cartridge 18 into the puncture pin 21 inside the housing. A piston (FIG. 3,30) is forced forward. Thereby holding the track 11 in the skiing position. This is a failsafe design in that a failure in the gas system results in the track moving backward, wherein the skier can't lock into his bindings.

For a release (either emergency or normal) a radio signal is received by the receiver 19. A linear motor or equivalent device such as a solenoid raises a plug 20 and releases the compressed gas from the housing 16. Then a powerful spring forces the piston (FIG. 3, 30) backward, quickly releasing the boot 6 from the binding system 2.

Figure 2:
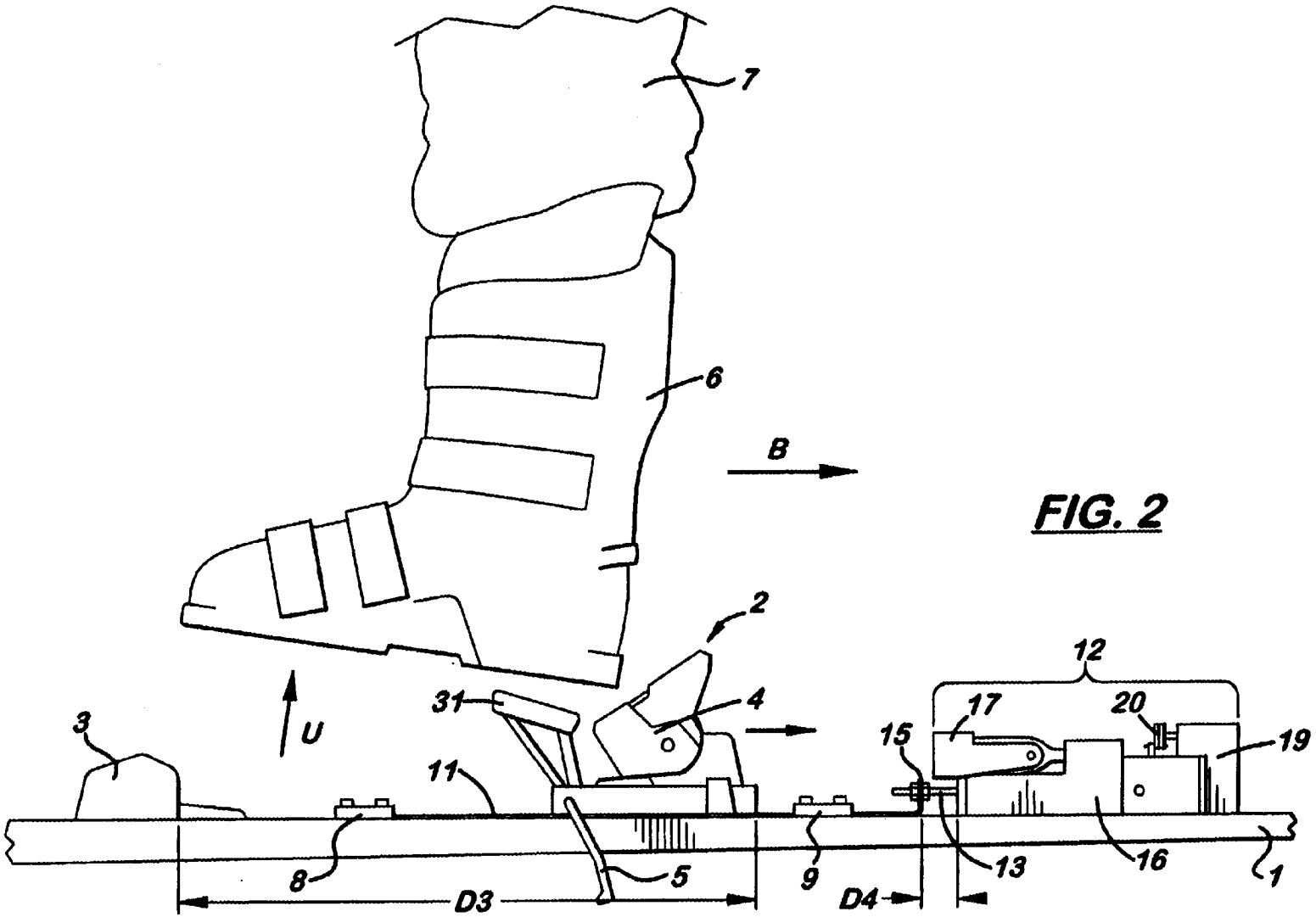
FIG. 2 is the same view as FIG. 1 with the ski boot released.

Referring next to FIG. 2 the skier 7 has hit his release button (preferably located on his ski pole handle). At release time the skier was leaning back. His boot has released up U and back B. Thus, an injury to the ACL has been avoided. Prototypes prove this release, even in a fully loaded (backward) fall position, will occur before the skier hits the ground.

At release time the snow brake 5 has pivoted down via the brake release pedal 31 in a known manner. Distance D3 is too long to hold the boot 6 in the binding system 2. Distance D4 is less than D2, and is a design choice. The prototype worked at D2–D4=one inch.

Figure 5:
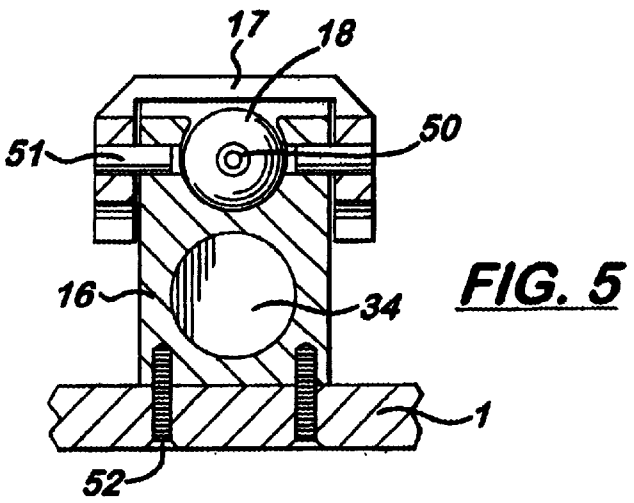
FIG. 5 is a cross sectional view taken along line 5—5 of FIG. 3.
Figure 4:
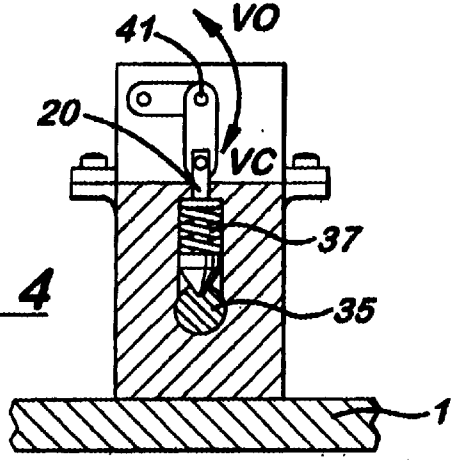
FIG. 4 is a cross sectional view taken along line 4—4 of FIG. 3.
Figure 3:
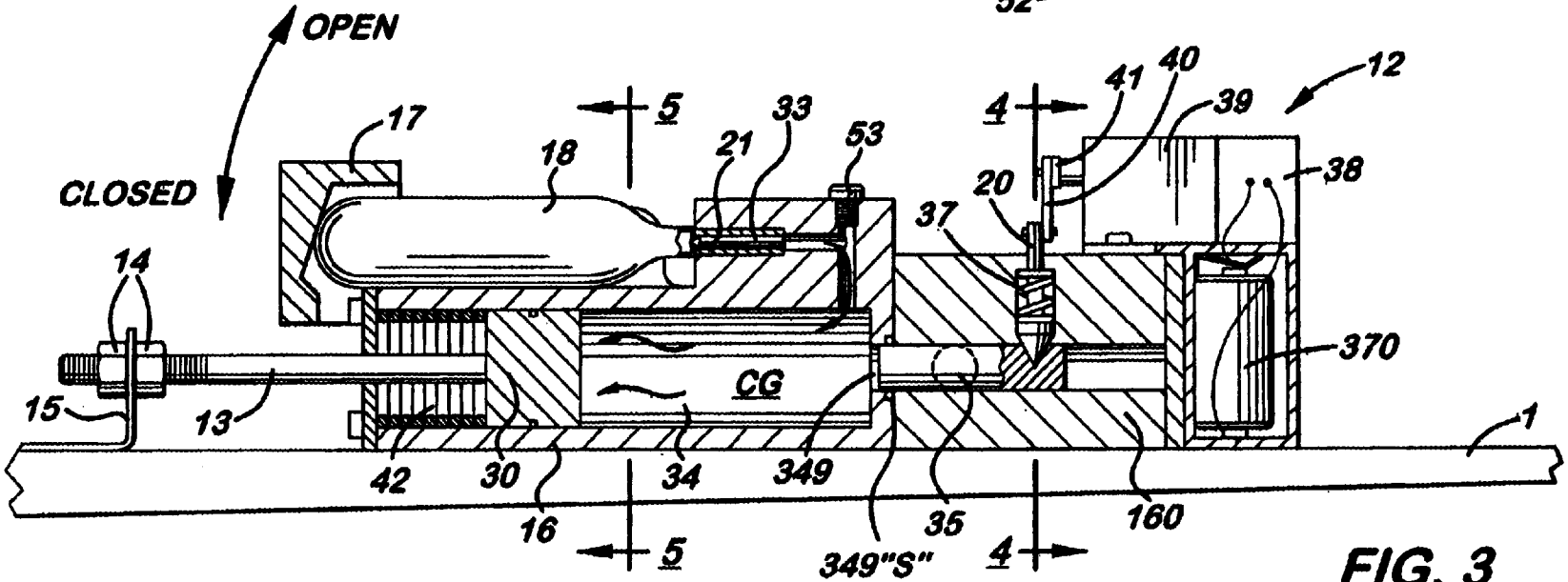
FIG. 3 is a longitudinal sectional view of the gas operated release mechanism.

Referring next to FIGS. 3,4,5 the prototype gas release system 12 is shown. The body 160 houses a plunger 35 for controlling the compressed gas CG. The lever arm 17 can be pivoted to the open and closed positions. The opening spring 42 has been compressed by the force of the compressed gas CG in the cylinder 34 on the piston 30. The channel 33 provides a fluid communication with the cylinder 34. An optional maintenance cap 53 is shown.

Figure 6:
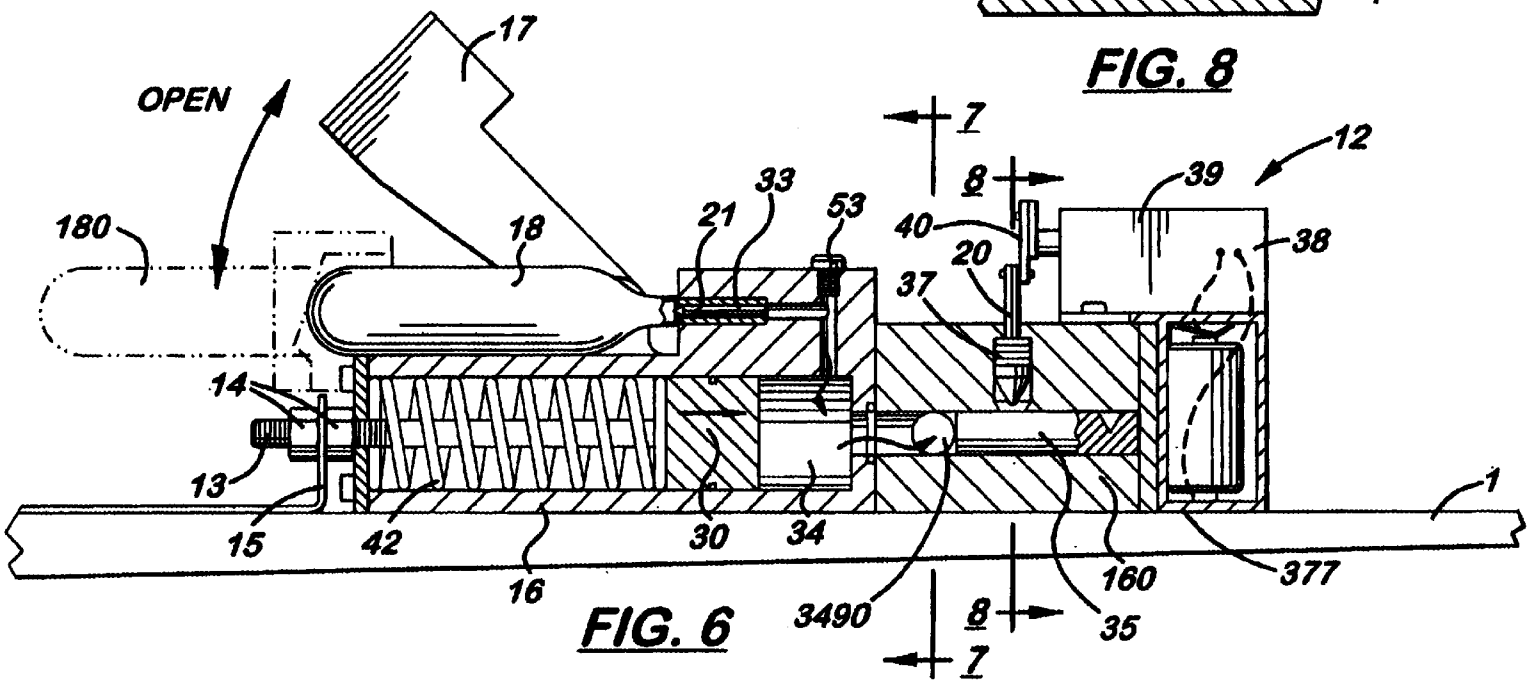
FIG. 6 is the same view as FIG. 3 with the gas cylinder unopened.
Figure 11:
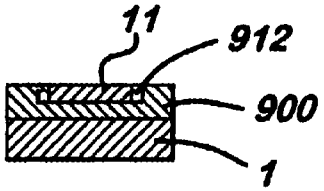
FIG. 11 is a cross sectional view taken along line 11—11 of FIG. 10.
Figure 10:
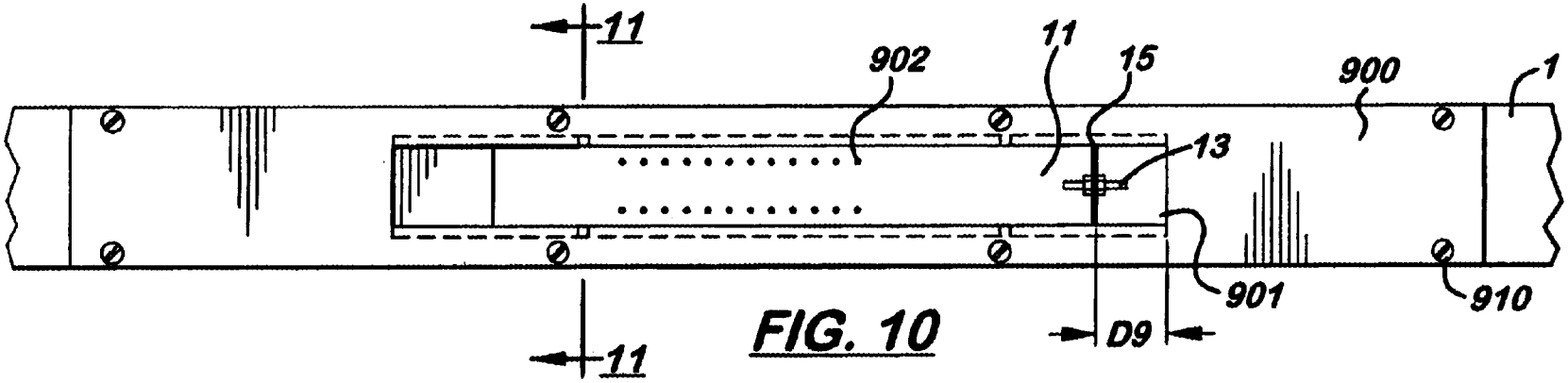
FIG. 10 is a top plan view of the plank mount embodiment.
Figure 9:
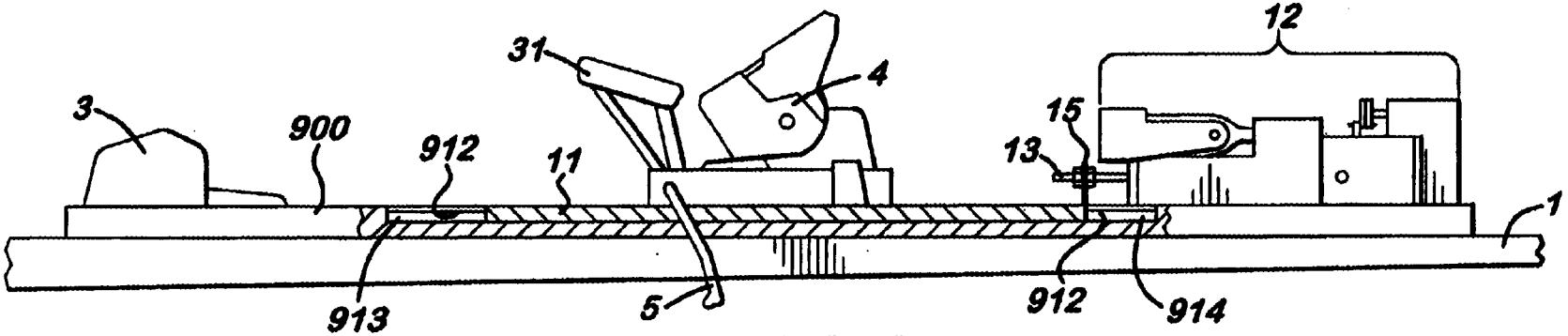
FIG. 9 is a right side partial sectional view of a plank mount embodiment.
Figure 12:
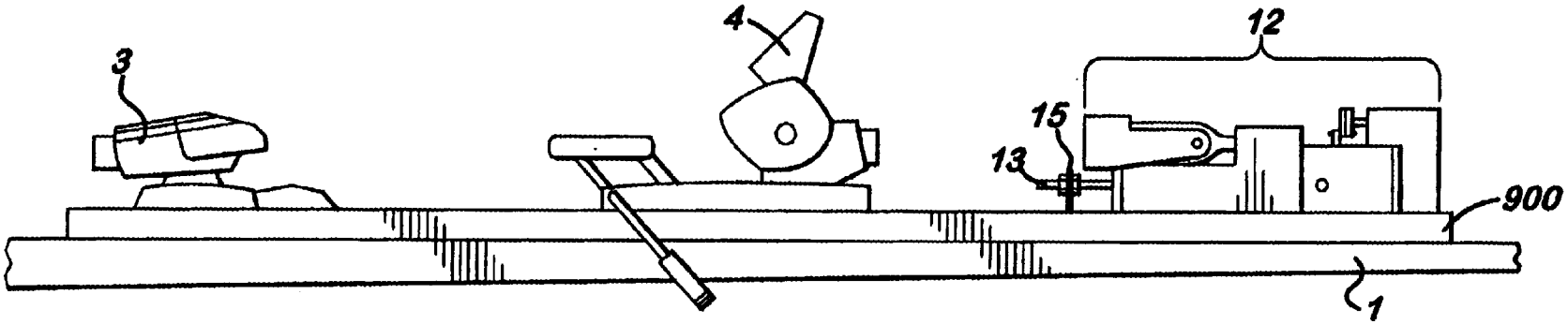
FIG. 12 is a right side plan view of the plank mount embodiment.

To release the skier from the binding the spring 42 needs to be released, and cylinder 34 is discharged. This is done by retracting plug 20 from detent 377 in plunger 35. Gas in cylinder 34 pushes thru port 349 moving plunger 35 to rear of port 349 breaking seal at "O" ring 349'S and exposing exhaust port 349 EXH, as shown in FIG. 6. This allows gas in cylinder 34 to escape to open atmosphere via vent 3490 and release all pressure on spring 42. Since piston arm 13 is attached to flange 15 by adjusting nuts 14 (two each), it moves track 11 and removes all holding power from the heel release 4. This immediately disconnects ski boot 6 from ski 1. As gas exits from port 3490 the tone of sound and decibel loudness may be greatly changed by size and design of port 3490.

When the cylinder 34 needs to be discharged, plug 20 is pulled up by a linear motor (not shown) in the actuator/receiver housing 39. The battery 370 powers both the radio receiver (not shown) and the linear motor. When the linear motor is in the valve closed position as shown in FIG. 4, the cylinder outlet 349 is closed by the plunger 35. The plunger 35 is held in the closed position by the plug 20 that fits into detent 377. A linkage 41 to the linear motor moves the valve stem 20 from the valve open VO to the valve closed VC positions.

In FIG. 5 the head 50 of the $CO_2$ cartridge 18 can be seen. It is pierced by the puncture pin 21 when the lever arm 17 is closed manually. Bolts 52 secure the housing 16 to the ski 1. The weight of the heel release mechanism 12 in the prototype was 1½ pounds, which did not effect skiing. The radio transmitter/receiver and linear motor of the prototype were taken from a radio controlled model airplane.

Figure 8:
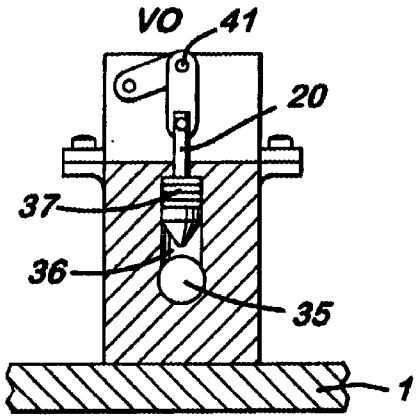
FIG. 8 is a cross sectional view taken along line 8—8 of FIG. 6.
Figure 7:
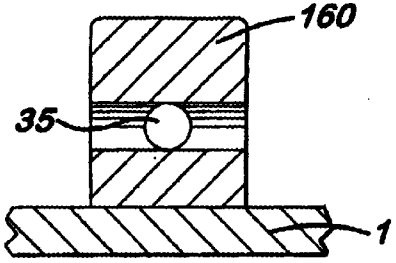
FIG. 7 is a cross sectional view taken along line 7—7 of FIG. 6.

Referring next to FIGS. 6,7,8 the release system 12 has been released via the receiver 38 activating the linear motor to pull the linkage 41 to the valve open VO position. Compressed gas has escaped through the cylinder outlet 349 and port 3490. A design choice allows a loud "bang" type noise (to find skis in powder) or a quiet mode. Also a colored gas can be used to help find skis in powder.

For re-charging the system a new cartridge 180 is shown in dots. The lever arm 17 is shown open.

Referring next to FIGS. 9,10,11,12 the equivalent system to that shown in FIGS. 1–8 has been modified to include a mounting board 900 that holds all the system components. The mounting board 900 is screwed to the ski 1 with screws 910. A groove 912 on the top of the mounting board 900 houses the track 11. The track 11 has the same flange 15. The ends of the groove at 913,914 are sized to allow the proper movement of track 11. Holes 902 provide for proper installation of the heel release 4 based on size. This mounting board could be used for the preferred embodiment of FIGS. 22–30.

Figure 13:
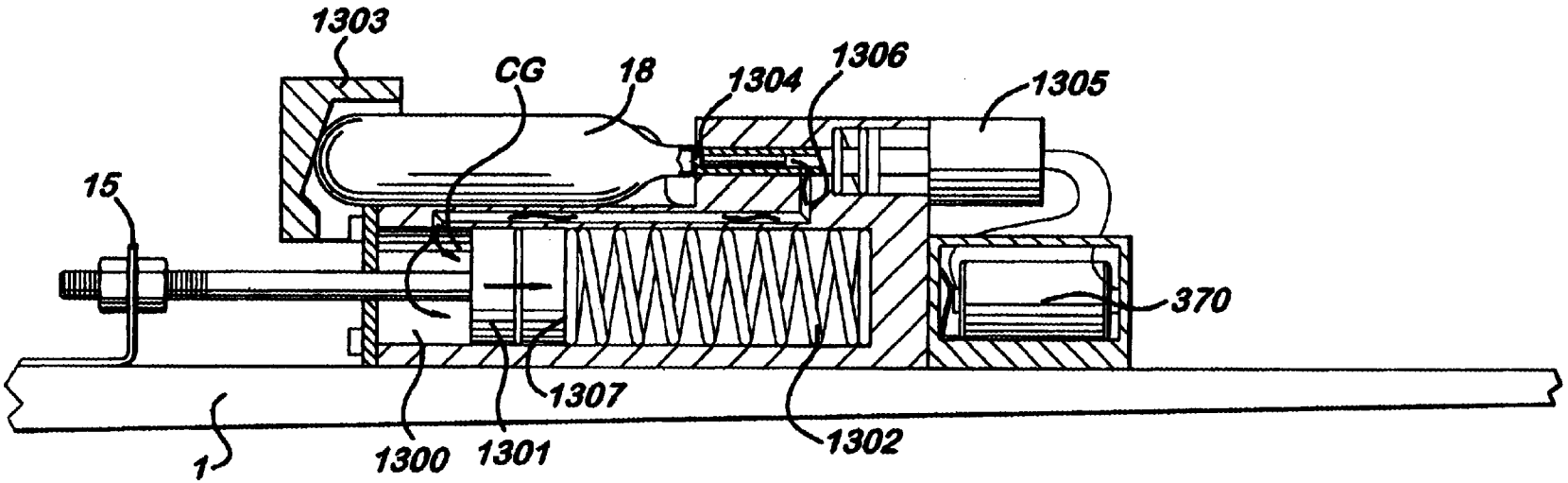
FIG. 13 is a longitudinal sectional view of an alternate embodiment gas release mechanism.

Referring next to FIG. 13 a reverse action gas release system is shown wherein the track 11 and flange 15 are the same as the earlier embodiment. In this case the skiing position is shown wherein the spring 1302 holds the piston 1301 all the way forward as shown. No compressed gas has been discharged yet.

The receiver and linear motor unit 1305 is activated by the same radio signal as the earlier embodiment. The linear motor unit 1305 forces a probe 1304 into the head of the compressed gas cylinder 18. Compressed gas CG flows through the channel 1306 to the cylinder 1300, thereby forcing the piston 1301 and the flange 15 backward and releasing the skier (normally without a bang). The piston ring 1307 is designed to slowly release the compressed gas after release (in perhaps a minute). For loading up the gas canister 18 a latch type door 1303 may be used.

Figure 14:
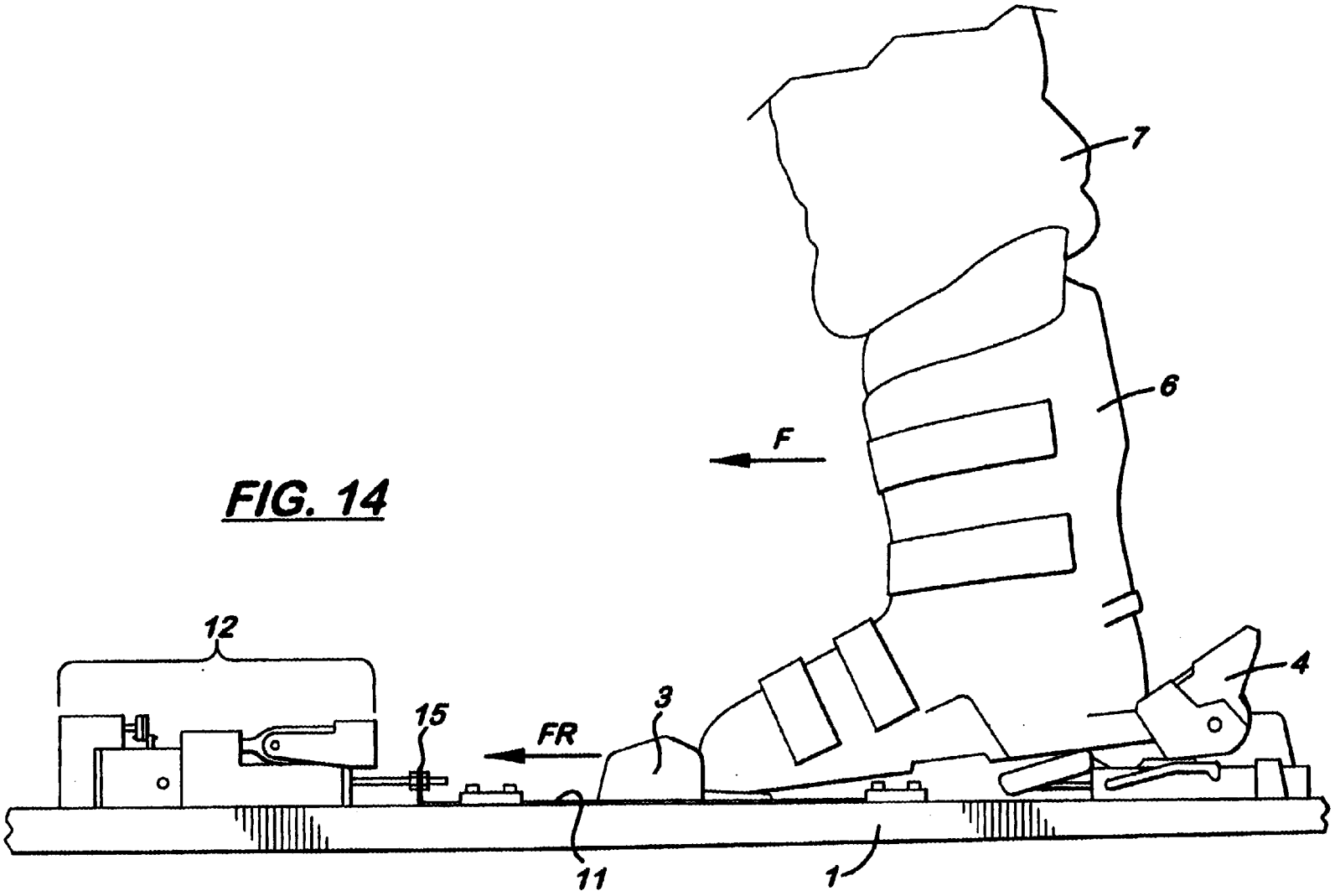
FIG. 14 is a right side plan view of a toe piece track release embodiment.

Referring next to FIG. 14 a moving toe piece embodiment is shown. The heel piece 4 remains fixed while the toe piece 3 is pulled forward FR by the flange 15 in a like manner as the earlier embodiments. In this case the ski moves backward relative to the release system 12, wherein in the heel mounted release systems the ski moves forward.

Figure 16:
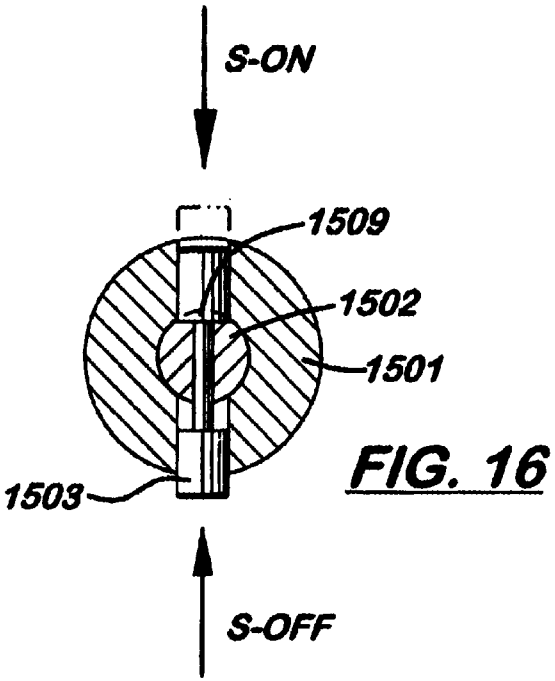
FIG. 16 is a cross sectional view taken along line 16—16 of FIG. 15.
Figure 15:
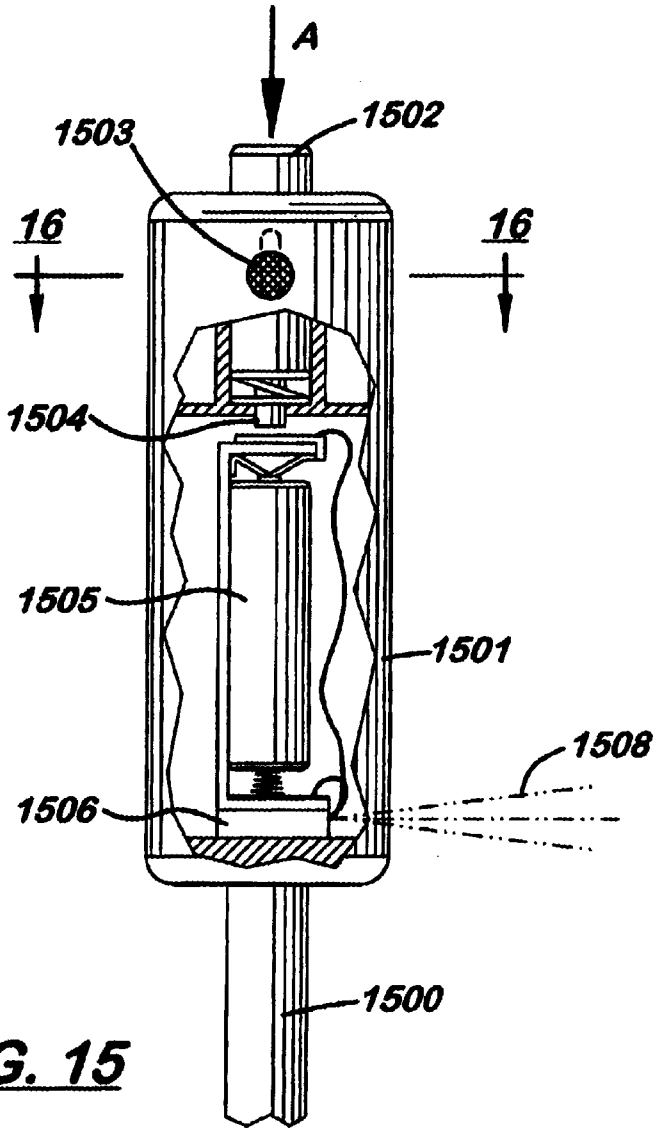
FIG. 15 is a partial cutaway view of the ski pole handle transmitter.

Referring next to FIGS. 15,16 the ski pole 1500 has a handle 1501. An activator button 1502 is mounted on top of the handle for thumb activation. Accidental discharges are prevented by safety switch 1503. The safety on S-ON position prevents the depressing of button 1502 because segment 1509 inserts into a hole in button 1503, locking it. In the safety off position S-OFF the button 1502 is free to be activated. Normally the skier would move to the S-OFF position only during a ski run, not on the lift or during transport.

For release the button 1502 closes switch 1504. The battery 1505 energizes the transmitter 1506 which sends signals 1508 to the ski mounted receiver. Known multiple frequency methods are used to create a large number of different frequencies in the field so as to prevent one skier releasing another's bindings. Short range transmitters also minimize this risk.

Figure 17:
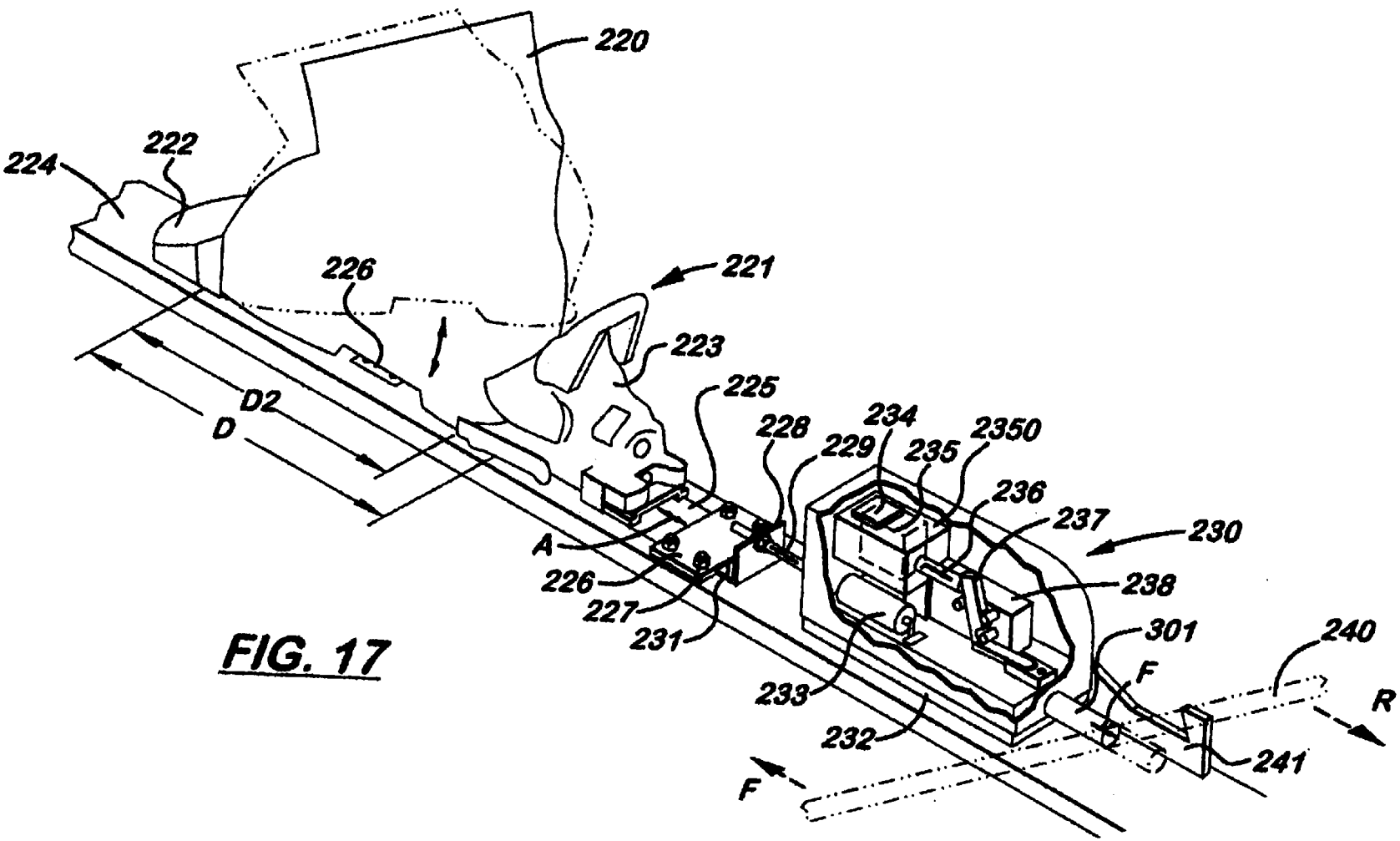
FIG. 17 is a top perspective view of a spring release mechanism embodiment on a traditional ski.

Referring next to FIG. 17 a ski boot 220 is shown stepping into a prior art downhill ski binding 221 which consists of a toe piece 222 and a heel piece 223. The dotted lines of the ski boot 220 show the traditional downward movement of the ski boot 220 for locking into the ski binding 221. The toe piece 222 is screwed into the ski 224 in a known manner. The proper mounting distance between the toe piece and heel piece for boot 220 is shown as $D_2$ (distance for skiing).

The heel piece is mounted to the track 225 instead of the ski 224. The track 225 can be a flat metal strip which slides under anchors 226 which are fastened to the ski with screws (or bolts) 227. A notch 231 under the anchors 226 receives the moveable track 225. When the spring release mechanism 230 pulls the track rearward for a release, (shown by arrow) then the distance between the toe and heel pieces increases to $D_r$ (distance for release).

Figure 25:
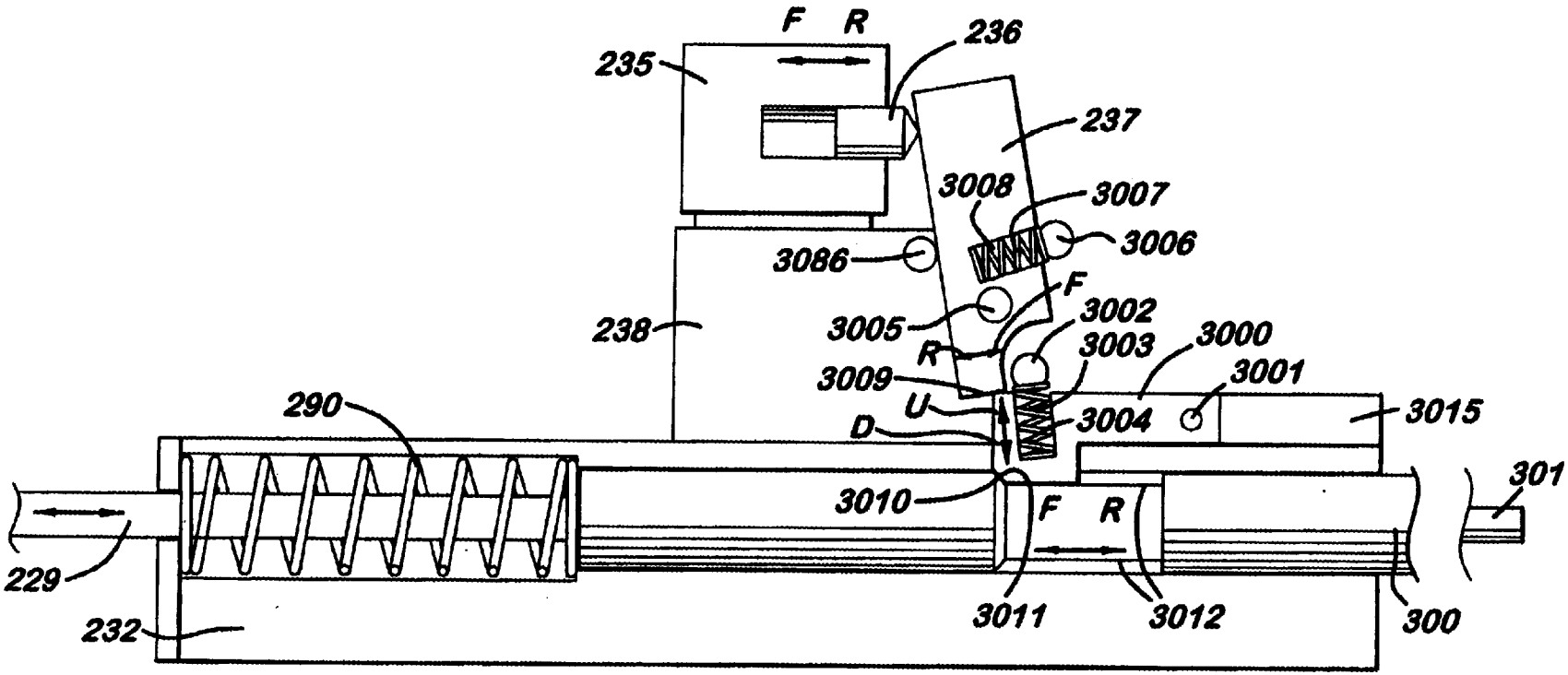
FIG. 25 is a same view as FIG. 24 with the spring housing locked.

The track 225 has a rear flange 228 which is connected to a shaft 229, which in turn is directly attached too a central piston (FIG. 25, 300). The spring release mechanism consists for a main housing 232, a receiver 234, a solenoid 235, an electronics housing 2350, a plunger 236, a trigger 237, and a trigger support 238. The outer case for the above components is numbered 230.

Figure 24:
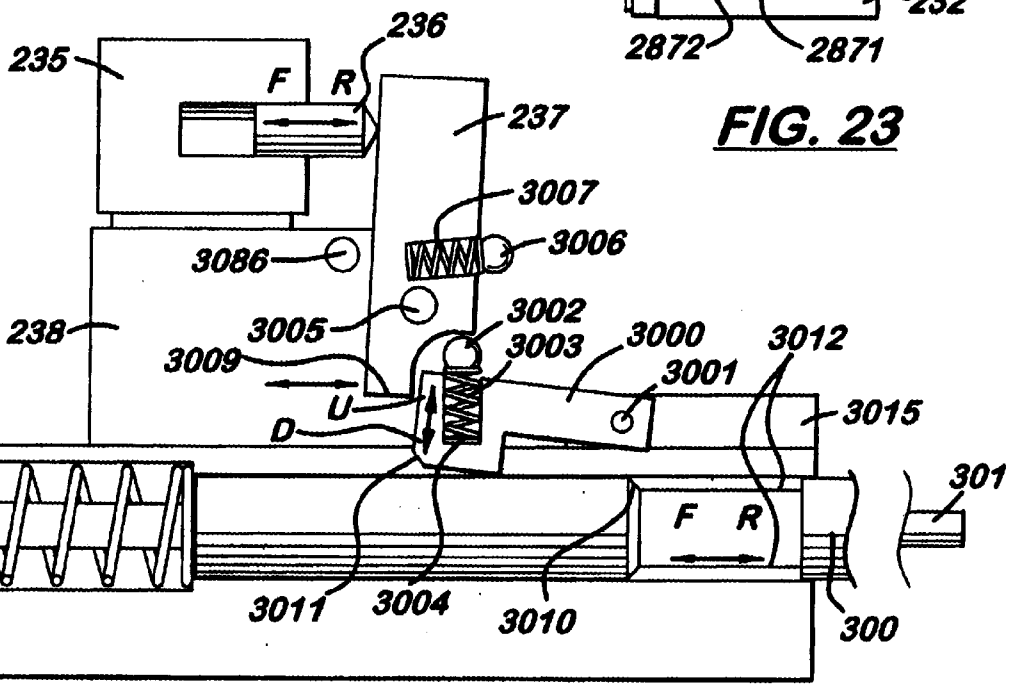
FIG. 24 is a longitudinal sectional view of the spring housing (released) of the spring release embodiment taken along line 24—24 of FIG. 22.
Figure 22:
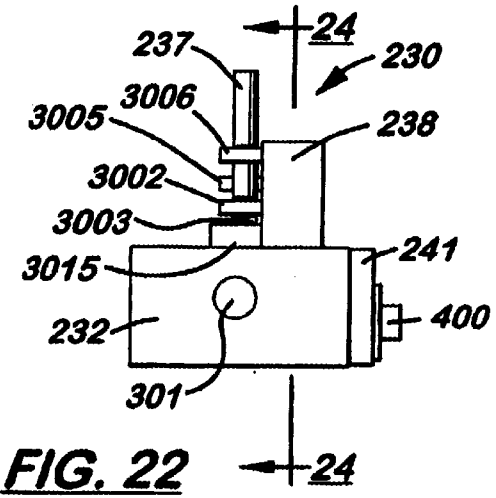
FIG. 22 is a rear plan view of the embodiment shown in FIG. 17.

In operation a skier cocks the spring release mechanism to the ski position shown in FIG. 25. A lever 240 (such as the tip of a ski pole) is used to push the central piston crank arm 301 forward in direction F. This is accomplished by pulling the lever 240 rearward in direction R against the fulcrum 241. The fulcrum is shown as a simple piece of metal extending rearward from the main housing 232. Now the traditional ski binding 221 functions in the traditional manner to release upon a forward force from the ski boot 220. However, as shown in FIGS. 15,16 a signal 1508 (preferably a radio signal) is generated by a skier to demand the instant release of his bindings. The receiver 234 receives the signal 1508 and activates the solenoid 235 to extend the plunger 236, thereby tripping the trigger 237. When the trigger 237 is tripped, the stored energy of the main spring (FIG. 24, 290) forces the central piston (FIG. 24, 3000) to the release position as shown in FIG. 24. The track 225 is pulled rearward in direction R, and the distance between the toe and heel pieces increases to distance $D_r$. In prototype mode the difference between $D_r$ and $D_s$ is approximately one inch.

Figure 18:
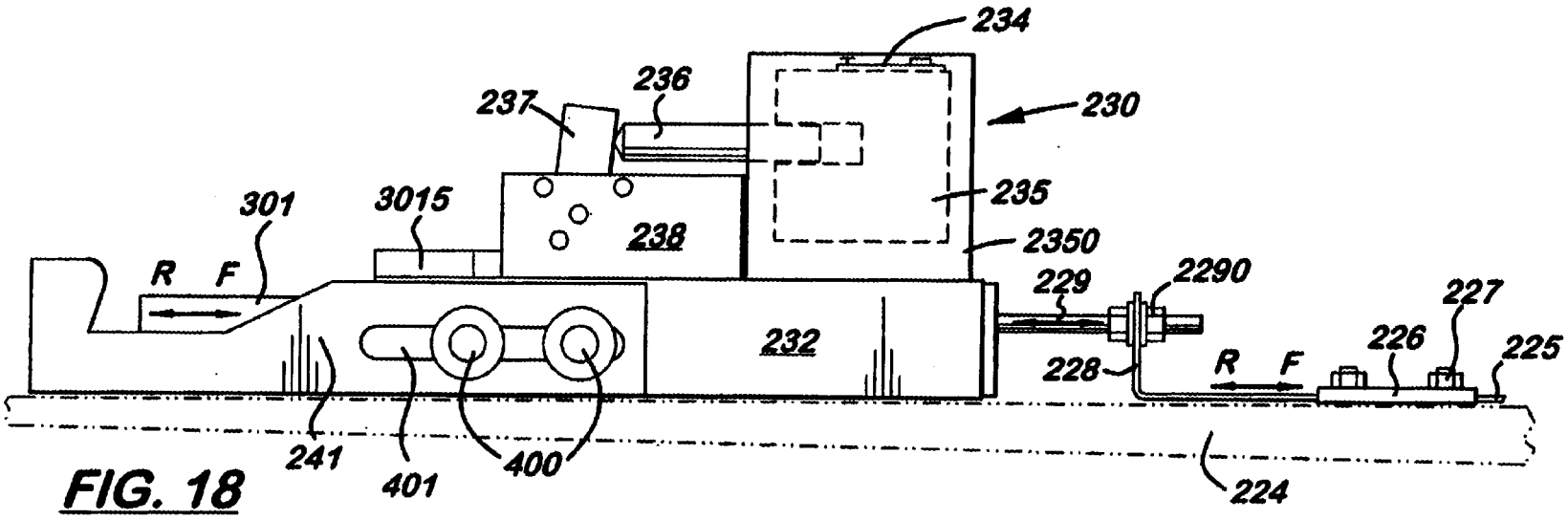
FIG. 18 is a left side plan view of the embodiment shown in FIG. 17.
Figure 19:
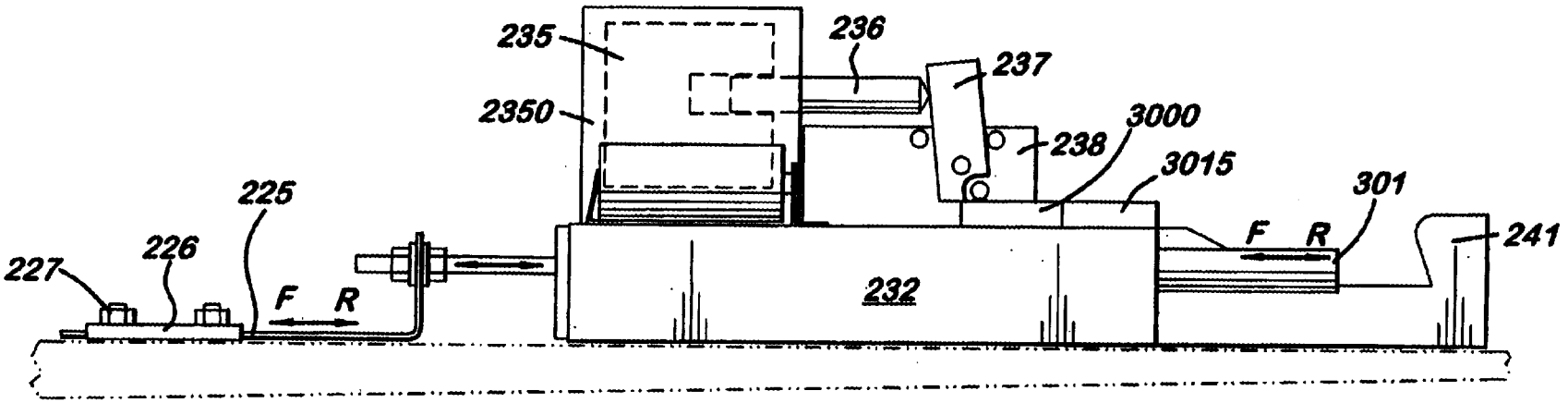
FIG. 19 is a right side view of the embodiment shown in FIG. 17.
Figure 20:
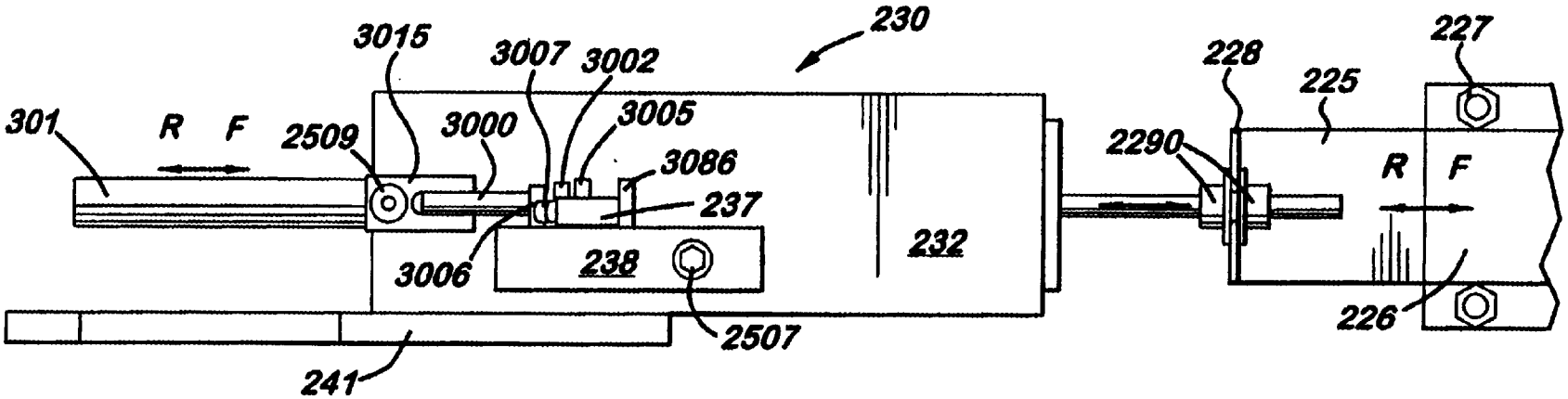
FIG. 20 is a top plan view of the embodiment shown in FIG. 17.
Figure 21:
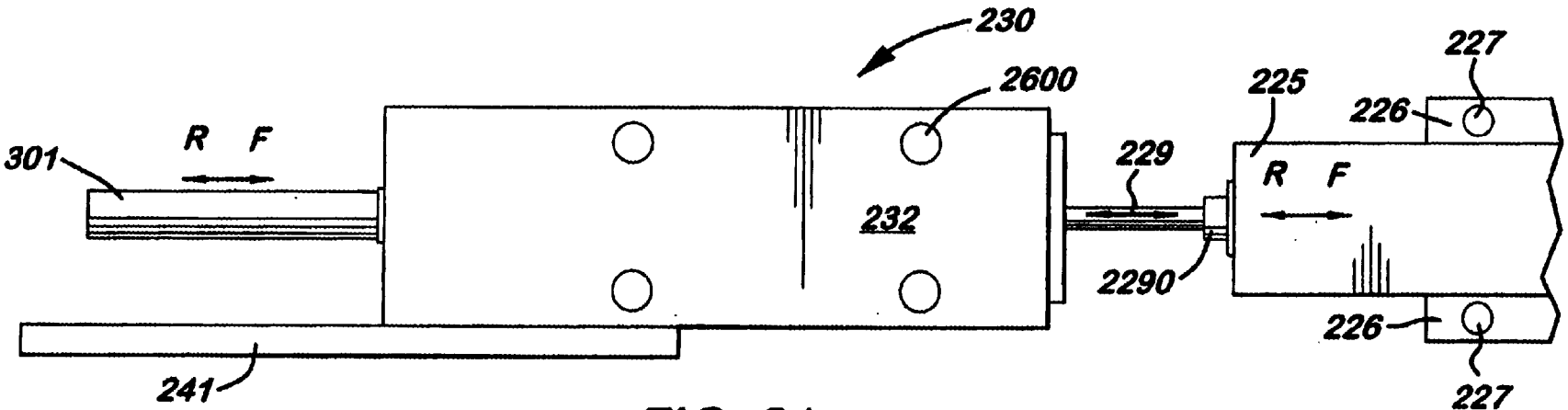
FIG. 21 is a bottom plan view of the embodiment shown in FIG. 17.
Figure 23:
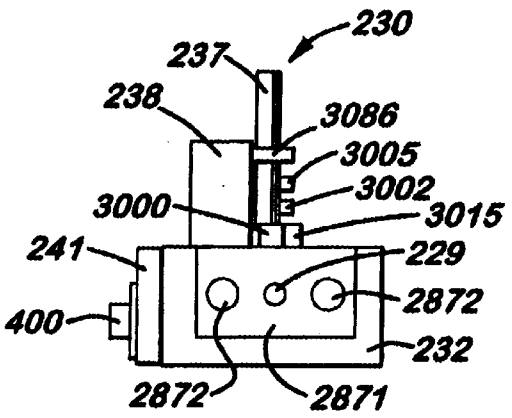
FIG. 23 is a front plan view of the spring housing of the embodiment shown in FIG. 17.

Referring next to FIGS. 18,19 the external appearance of the trigger 237 and its related functional parts is shown in plan view. The housing 232 forms a base for the fulcrum 241. A slot 401 allows adjustment of the rearward positioning of the fulcrum 241 with bolts 400. The solenoid is mounted inside the electronic housing 2350, said housing counteracts the electronic force generated to move the plunger 236 rearward to trigger the trigger 237. Bolts 2290 secure the shaft to the flange 228. The trigger 237 controls the movement of a catch (also called a locking pin) 3000. A base 3015 forms a pivot for the catch 3000 to pivot from.

Referring next to FIGS. 20,21,22,23 the solenoid and electronic components have been removed to better show the mechanical parts. The spring housing 232 has mounting holes 2600 on the bottom for attachment to a ski. A bolt 2507 secures the trigger housing 238 to the spring housing 232. A bolt 2509 secures the catch base 3015 to the spring housing 232. Pin 3086 is a forward stop for the trigger 237. Pin 3005 is a pivot for the trigger 237. Pin 3006 is a stop for spring 3007 which pushes the trigger 237 over the catch 3000 in the cocking operation. Pin 3002 is a stop for spring 3003 which pushes the catch 3000 into the groove 3012 which is located on the peripheral surface of central piston 300.

The operation of the spring mechanism 230 is best seen in FIGS. 24,25. The electronic parts have been removed. The technical challenge is to store enough energy in the spring 290 to violently pull the track 225 rearward on demand to release. The further challenge is to work with the limited power available with a light weight battery pack on board the ski. Too much added weight is not practical for downhill skis. The solution is a catch 3000 which has a locking corner 3011 which is forced into a locking engagement with a locking edge 3010 of the groove 3012 on the outside of the central piston 300. The spring 3003 forces the catch downward in direction D when the spring is fully compressed. This locked and ready to ski mode is shown in FIG. 25. The spring 3007 forces the trigger 237 to lock the catch down.

When the skier pushes his release button to send a (preferably radio) signal to the receiver 234, the solenoid (or linear motor) is powered, thereby forcing plunger 236 against the trigger 237. The trigger 237 has a pivot pin 3005, and so the plunger 236 moves the locking bottom edge 3009 off the top of the sear, thereby allowing the spring 3003 to raise the catch around its pivot pin 3001. As this occurs the locking surfaces 3010,3011 are released, and the spring 290 violently discharges its stored energy and pulls the track 225 rearward. This rearward force does overcome both the force of the weight of the skier as well as the force of any ice and debris that has collected on the ski. The release mode is shown in FIG. 24. The cavity 3004 in the catch 3000 holds the spring 3003.

Figure 26:
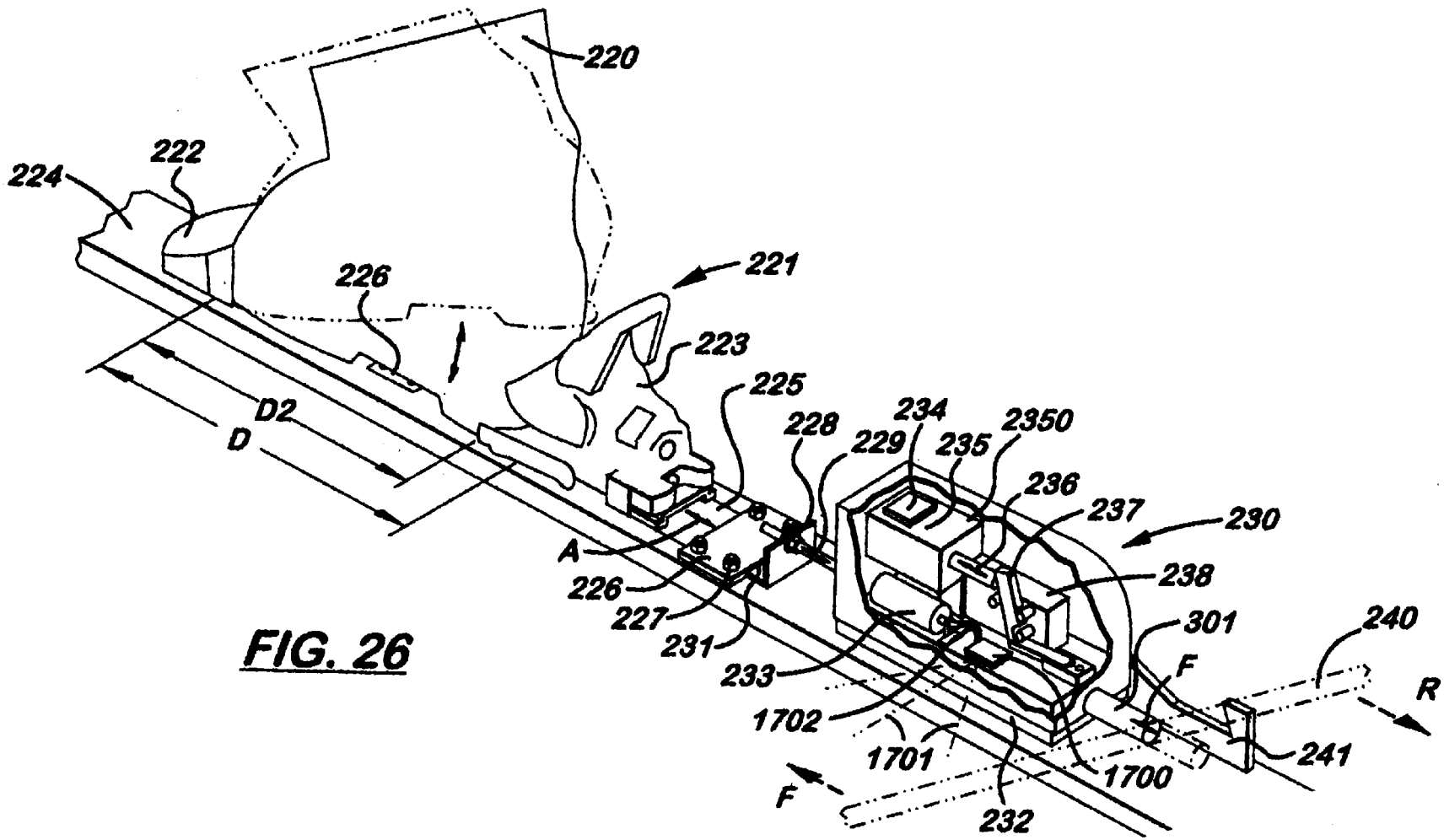
FIG. 26 is the same view as FIG. 17, but the binding housing has an optional sound module, a chirper chip.

Referring next to FIG. 26 the same system as FIG. 17 is shown. However, an optional sound module 1700 is mounted inside the outer case 230. The same battery 233 that powers the solenoid 235 can power the sound module 1700 via wire 1702. Known sound modules include chirper chips used in battery powered fire alarms. A skier who lost his ski in powder (worth perhaps $700.) can now press his ski pole handle button (FIG. 15, 1502) to make a chirping sound to help locate his ski. The on-board 9 volt battery could also power a mini speaker (not shown) to get more noise.

Figure 27:
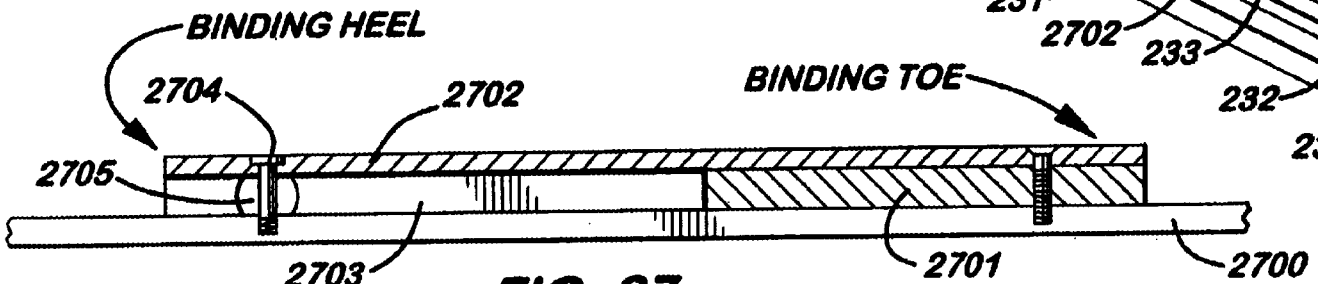
FIG. 27 (PRIOR ART)
FIG. 27 (prior art) is a longitudinal sectional view of a Dynastar® floating heel plate ski.

Referring next to FIG. 27 a prior art Dynastar® Autodrive™ ski 2700 is shown. The idea is to mount the binding onto a flexible plate 2702 in order to get better flex from the ski which now is not compressed by bolts from the binding heel. A flexible cushion layer 2703 supports the heel segment of the metal mounting plate 2702. The toe segment of the binding is supported by a filler layer 2701. As the ski arcs the heel segment of the metal mounting plate floats with support post 2704 moving in cavity 2705.

Figure 28:
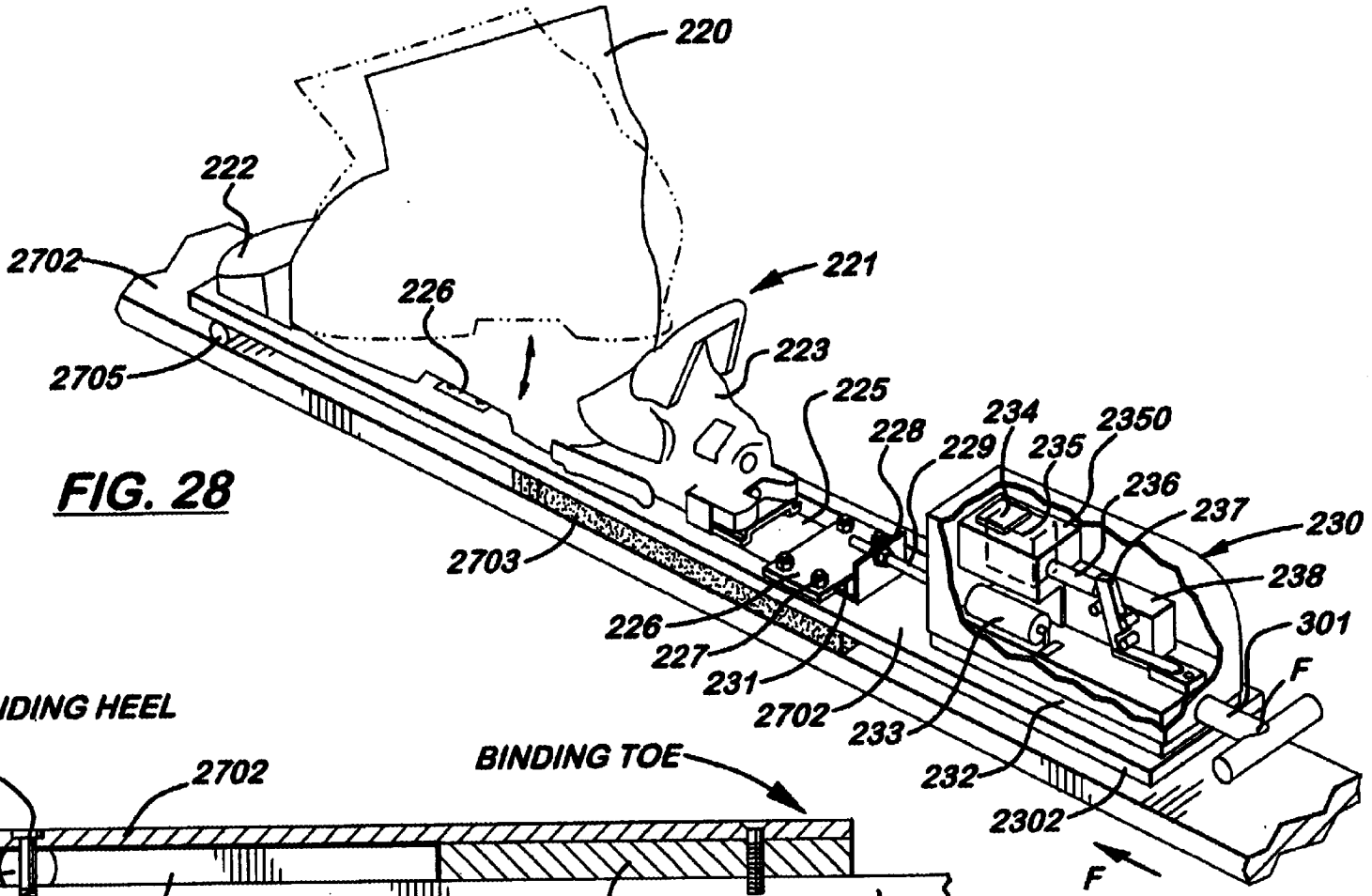
FIG. 28 is a top perspective view of a spring release embodiment mounted on the ski shown in FIG. 27.

FIG. 28 is the same as FIG. 17 except for the use of the ski 2700. The metal mounting plate holds the entire binding and release assemblies.

Figure 29:
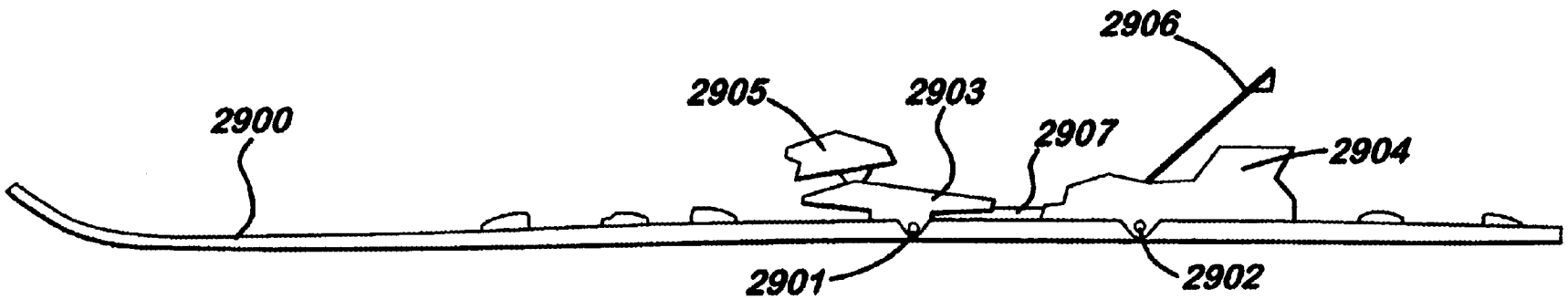
FIG. 29 (PRIOR ART)
FIG. 29 is a side plan view of a Salomon® Pilot™ integrated ski and binding system.
Figure 30:
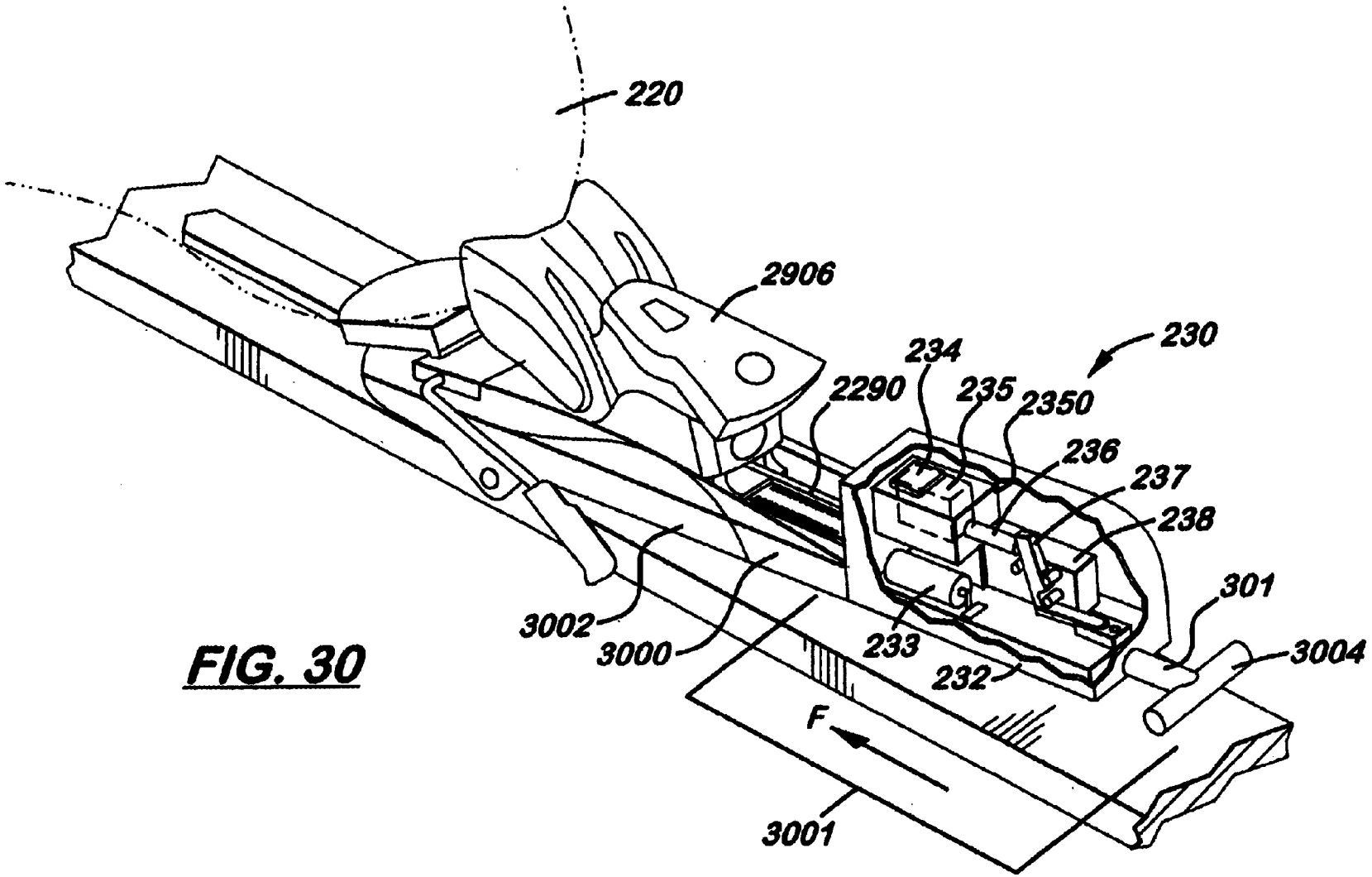
FIG. 30 is a top perspective view of the preferred embodiment, a pivoting mounting plate type ski having the binding heel element mounted on the rear pivoting mounting plate.

Referring next to FIG. 29 a Salomon® Pilot™ system features an integrated ski and binding system. No longer are the binding toe member 2905 nor the binding heel member 2906 bolted directly onto the ski. Instead a toe mounting plate 2903 receives the binding toe member 2905, and the heel mounting plate 2904 receives the binding heel member 2906. A toe pivot axis 2901 secures the toe mounting plate 2903 to the ski 2900 via a hole in the ski body filled by a bolt around which the toe mounting plate can pivot.

A torsion bar 2907 connects the toe mounting plate 2903 to the heel mounting plate 2904. The heel mounting plate 2904 pivots around a heel pivot axis 2902. The same hole through the body of the ski construction is used as for the toe pivot axis 2901.

Each of the binding members has an elongate base that is mechanically adjustable for positioning along a U shaped track to size the bindings to the boot.

In the preferred embodiment herein the heel mounting plate is modified to accommodate a spring type release assembly, similar to that shown in FIG. 17, wherein the binding heel member base 3000 is spring loaded into a release assembly 3001. The U shaped track of the heel mounting plate is numbered 3002. There is no longer a need for a separate track as shown in FIG. 17, 225. The shaft 2290 from the release assembly 3001 is connected directly to the heel member base 3000. For sizing the boot the shaft 2290 is selected for the desired length. Alternate boot adjustment means could include an adjustable mount for the release assembly 3001.

Design choice could move all the electronics under the heel mounting plate. Cocking the main spring of the release mechanism can be done by placing the ski tip in the snow and pushing on the cocking handle 3004.

A functionally equivalent release mechanism could be installed on the toe mounting plate, but the visual aesthetics of looking down at your emergency backwards release mechanism might not be appealing.

Although the present invention has been described with reference to preferred embodiments, numerous modifications and variations can be made and still the result will come within the scope of the invention. No limitation with respect to the specific embodiments disclosed herein is intended or should be inferred.

I claim:

1. An improvement to a binding and ski integrated system, said integrated system having a ski, a pivotable heel mounting plate and a binding toe member connected to the ski, said pivotable heel mounting plate having a single heel pivot axis connection to a ski base, the improvement comprising:

a track in the heel mounting plate;

a binding heel member having a base attached to the track;

a release actuator associated with the track to increase a mounting distance between the binding toe member and the binding heel member by sliding the binding heel member and track rearward; and wherein the release actuator further comprises a compressed gas cylinder having a release plug.

2. An improvement to a binding and ski integrated system, said integrated system having a ski, a pivotable heel mounting plate and a binding toe member connected to the ski, the improvement comprising:

a track in the heel mounting plate;

a binding heel member having a base attached to the track;

a release actuator associated with the track to increase a mounting distance between the binding toe member and the binding heel member by sliding the track rearward; and wherein the release actuator further comprises a compressed gas cylinder having a release plug.

3. An improvement to an integrated ski and binding system, said system having a pivotable heel mounting plate, said heel mounting plate having a channel to receive a base of a binding heel member, a binding toe member mounted to the ski, wherein a ski boot size is accommodated by setting a distance $D_1$ between the binding toe member and the binding heel member, the improvement comprising:

an extension mechanism mounted on the pivotable heel mounting plate;

said extension mechanism having a gas powered stored energy source to pull the base of the binding heel member rearward to a distance greater than $D_1$ on demand.

4. A ski binding release system comprising:

a ski having a pivotable heel mounting plate;

a slidable binding heel member mounted in the pivotable heel mounting plate;

a binding toe member connected to the ski to form a boot mount distance $D_1$ between the binding toe member and the binding heel member;

a gas powered release assembly connected to the pivotable heel mounting plate;

said gas powered release assembly having a receiver; and wherein said gas powered release assembly pulls the binding heel member rearward on demand.

5. An improvement to a binding and ski integrated system, said integrated system having a ski, a pivotable heel mounting plate and a binding toe member connected to the ski, the improvement comprising:

a track in the heel mounting plate;

a binding heel member having a base attached to the track; and a gas powered release actuator associated with the track to increase a mounting distance between the binding toe member and the binding heel member by sliding the track rearward.

6. An improvement to a binding and ski integrated system, said integrated system having a ski, a pivotable toe mounting plate and a binding heel member connected to the ski, the improvement comprising:

a track in the toe mounting plate;

a binding toe member having a base mounted to the track; and a gas powered release actuator associated with the track to increase a mounting distance between the binding toe member and the binding heel member by sliding the binding toe member forward.

* * * * *